United States Patent [19]

Breckheimer

[11] 4,119,392

[45] Oct. 10, 1978

[54] SCREW COMPRESSOR WITH AXIALLY DISPLACEABLE MOTOR

[75] Inventor: Hans Breckheimer, Eschborn, Germany

[73] Assignee: Demag AG, Duisburg, Germany

[21] Appl. No.: 743,780

[22] Filed: Nov. 22, 1976

[30] Foreign Application Priority Data

Nov. 27, 1975 [DE] Fed. Rep. of Germany ..... 2553222

[51] Int. Cl.[2] ..... F01C 1/16; F01C 21/12; F04C 17/12; F04C 29/08

[52] U.S. Cl. ..... 418/201; 418/21; 417/284

[58] Field of Search ..... 418/21, 24–27, 418/197, 201, 203; 417/284

[56] References Cited

U.S. PATENT DOCUMENTS

| | | | |
|---|---|---|---|
| 1,677,980 | 7/1928 | Montelius | 418/203 |
| 2,645,901 | 7/1953 | Elkins | 418/21 |
| 3,307,777 | 3/1967 | Schibbye | 418/201 |
| 3,947,078 | 3/1976 | Olsaker | 418/203 |

FOREIGN PATENT DOCUMENTS

| | | | |
|---|---|---|---|
| 575,989 | 4/1958 | Italy | 418/26 |
| 781,950 | 8/1957 | United Kingdom | 418/26 |

*Primary Examiner*—John J. Vrablik
*Attorney, Agent, or Firm*—Mandeville and Schweitzer

[57] ABSTRACT

The invention deals with a screw compressor with housing, such housing containing a working chamber with two parallel cylindrical intersecting bore holes. The working chamber is bordered by two even end walls vertical with the longitudinal axes of the bore holes; two helical or screw rotors are arranged in the working chamber revolving and engaging and sealed against the chamber walls so that they do not touch the latter, whereby there is axial clearance due to the manner of construction between the frontal walls of the chamber and the fronts of the helical part of the rotor, whereby the screw compressor is provided with a control for volume which causes the output to be decreased by returning the gas sucked into gaps to the suction chamber before compression starts.

5 Claims, 7 Drawing Figures

SCREW COMPRESSOR WITH AXIALLY DISPLACEABLE MOTOR

BACKGROUND AND STATEMENT OF THE INVENTION

Volume control is almost always required for compressors, as the volume output produced by the compressor hardly ever equals the demand, and the excessive pressurized gas is not to escape uselessly into the atmosphere. The volume may be influenced by altering the speed of the compressor. Practically, this method is limited to those compressors which are used with combustion motors, because in electric operation, mostly rotary current motors with fixed number of revolutions are used. Compressors driven by a constant number of revolutions, therefore, require special control devices.

Control devices for continuous regulation of volume output of screw compressors have been disclosed (West German Pat. Nos. DT-OS 1,628,382, DT-OS 1,628,385) where slide valve control is utilized. This device consists mainly of a control slide valve arranged between the engaging helical rotors. The slide valve is designed with the same cross section as the housing. When moving the slide valve in the direction of the outlet, a space is freed through which the gas already aspirated may flow back to the suction side. The further the slide valve is opened the more the actually aspirated gas quantity decreases. The control edge of the control slide valve is also moved towards the pressure side so that the built-in pressure ratio is maintained essentially constant for a sufficiently large control area. The control slide valve is actuated pneumatically, hydraulically, or mechanically.

Partial load conditions of the described continuous slide valve control are shown on the enclosed drawing (FIG. 1) by the line drawn between points 1 and 2. Compared with the ideal line which runs as a straight line between points 1 and 6 and which indicates the least operating requirements for the decreased volume output, there is some deviation, which becomes more obvious with decreasing percentage figures. Relief is already provided for volume output flow of less than 20% approximately by discharging into the atmosphere or by decompression of compressed gas in the suction line. When gas counter pressure is eliminated and the control slide valve is completely opened, i.e., without internal compression, operation requirements at zero delivery (the so-called idling) at point 3 only amounts to 10% approximately compared with the operation requirements at full delivery (point 1).

The control device described above, regulating the volume for screw compressors has not met with general success, being that it requires high construction expenditures making it too expensive.

Another known control device for continuous regulation of volume flow in screw compressors is described in DEMAG News, Issue 182, 1966, in an article titled "DEMAG Helical Compressor, Operation, Construction, Comparison with other compressor constructions, field of application, and special constructions". The control device consists mainly of a throttle provided in the suction line of the screw compressor. Regulation by means of a throttle is very wide-spread in screw compressors, as the control devices required for this hardly matter economically.

On the other hand, this type of control has a considerable disadvantage. Operating requirements decrease very little with decreasing volume output flow in throttle controls, as may be seen on the attached drawing (FIG. 1). This becomes particularly obvious when tracing the line (throttle regulation) between points 1 and 4 as opposed to slide valve regulation. When the throttle is completely closed, zero delivery of the compressor occurs. Operating requirements at point 4 still amount to 75% approximately as opposed to full load. When relieving the compressor by discharging into the atmosphere or by decompression in the suction line, i.e. elimination of gas counter pressure, operating requirements at point 5 result in 50% as opposed to full load, which, dependent upon the built-in pressure ratio, may also be higher. In general, however, operating requirements are always higher in throttle regulation than in valve regulation which is due to the fact that despite compressor relief the built-in pressure ratio is maintained, and a corresponding amount of compression work must be done.

For the above-mentioned slide valve, as well as throttle regulation, no special pressurized container is necessary for the continuous control of volume output flow. In the areas of partial load, however, the mentioned losses occur compared to the ideal line. Such losses can be eliminated by providing a pressurized vessel, in accordance with requirements, as a holding tank between the compressor and consumption, and operating only a full delivery (point 1), and idling (point 6). This so-called by-pass or standstill control offers maximum economy as in full delivery the compressor operates with specifically lowest operating requirements and in idling there are no losses. However, this type of regulation cannot be utilized at all times. Specifically, once the pressurized vessel volume is decreased in order to obtain a reasonable price of acquisition, more frequent switching operations (on and off) are entailed for the compressor components. The often-used electro-motors overheat so that by necessity operation between full (point 1) and zero (point 6) delivery is impossible. Instead, the motor continues to run and the compressor idles at zero delivery. For slide valve control and relief this applies to point 3, for throttle control and relief to point 5. In order to attain economical operation of a screw compressor provided with so-called continuous control, it is of the utmost importance that operating requirements, particularly for longer periods of zero delivery, are as low as possible.

It is the object of the invention to propose a screw compressor of the type mentioned initially, with control device to regulate volume output flow which, while being of simple construction, facilitates the lowest possible operating requirements for the compressor. This is solved by designing the helical part of at least one of the rotors — given the axial clearance necessitated by the construction — shorter than the axial distance between the end walls of the working chamber therefor and by making this shorter rotor axially displaceable. In accordance with this arrangement, one of the rotors of the screw compressor is displaced towards the suction side during operation, so that a free space is formed on the pressure side within the housing. A connection is made between this space and the suction side via gaps formed between the rotors. This facilitates zero delivery while idling without internal compression. The check valve required in the pressure line, in accordance with governing regulations, prevents the return of the compressed gas from the consumption side. When full delivery is to commence again, the rotors must be returned to their starting position. As internal compression is completely eliminated during zero delivery and idle running and sufficiently large overflow cross sections are opened toward the suction side, no compression losses occur and reverse flow losses are reduced to a minimum. Due to the small operating requirements in idle run, the control device is also suitable to assist in starting the compressor operation initially. During full delivery the effectiveness of the screw compressor is not impaired.

For structural reasons, it is advantageous to design the non-driven, i.e. female, rotor shorter. In accordance with another characteristic of this invention the shorter rotor is axially displaceable by means of a piston. For practical reasons, the piston is positioned in a cylinder connected to a pressure medium source. Another detail of the invention provides unilateral charge of the piston with a pressure medium and places the piston under the influence of a return spring.

DESCRIPTION OF THE DRAWINGS

FIG. 4 is an additional longitudinal view of the screw compressor of the invention in the position shown in FIG. 2;

FIG. 5 is an additional longitudinal view of the screw compressor of the invention in the position shown in FIG. 3.

FIG. 6 is a cross sectional view taken along lines 6—6 of FIG. 2; and FIG. 7 is a cross sectional view taken along lines 7—7 of FIG. 3.

FIG. 1 consists of a diagram showing a comparison of actual partial load conditions of screw compressors using prior throttle and slide valve controls with the desired ideal conditions between stand-still and full delivery. Along the abscissal axis are entered the values of volume output in percentage figures as opposed to full delivery. Along the ordinate are entered the values of operating requirements in percentages of full delivery for the individual types of regulation. Point 6 corresponds to zero delivery while idling, and point 1 diagonally opposite corresponds to full delivery.

FIG. 2 shows the rotor pair consisting of male rotor 1 and female rotor 2 engaged within housing 3. Rotor 1 driven via pinion 4 rests in bearing plate 5 in roller bearing 6 on the suction side of the compressor, such roller bearing 6 being designed as a thrust bearing, while on the pressure side it rests in a bearing combination consisting of roller bearing 7 and four-point bearing 8 which is the stationary bearing. The bed bolts of the female rotor 2 rest in the stationary roller bearing 14 on one side and, on the other, in a combination consisting of stationary roller bearing 15 and ball bearing 13 which is axially displaceable. The length of the helical part of female rotor 2 is, beyond the structurally required axial clearance, shorter by "X" than the length of the helical part of male rotor 1 and/or the length of the cylindrical operating space in housing 3.

In order to facilitate displacement of rotor 2 within housing 3 by "X" the inner rings of roller bearings 14 and 15 are developed accordingly. Plate spring 16, shown in FIG. 3 in expanded position, is arranged between stationary bearing 15 and axially displaceable bearing 13. Four-point bearing 13 is connected to a piston 11 which is displaceable within cylinder 12. The chamber of cylinder 12 is connected to a pressure medium line (not shown) via hollow screw 9. Hollow screw 9 further serves as adjustable stop for piston 11 and is secured in the desired position by means of nut 10. FIG. 2 shows rotor position at full delivery.

Figure 1:
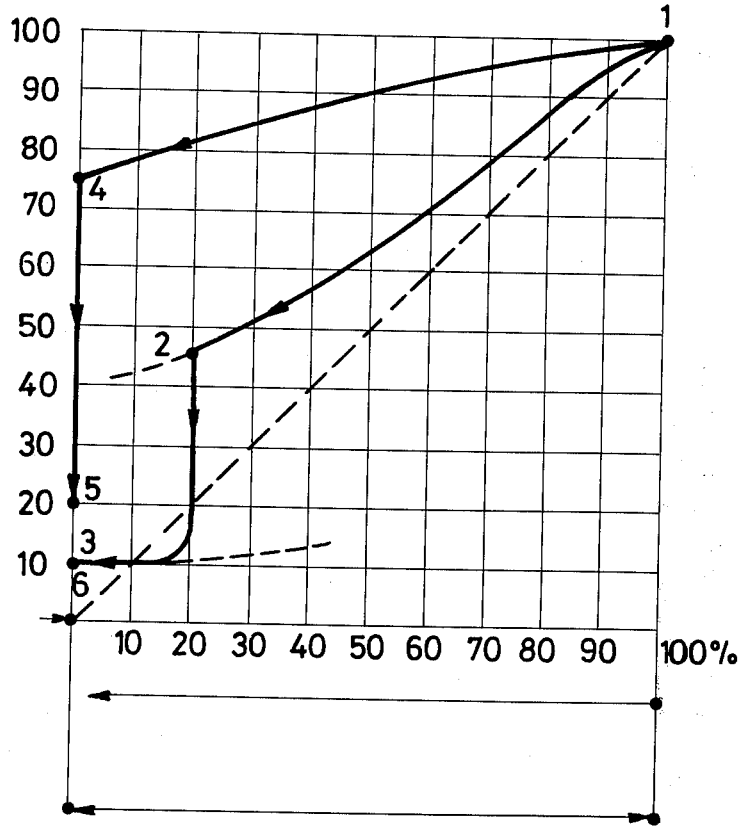
FIG. 1 is a graph showing the relationship between operating requirements of a screw compressor and the output therefor under various control procedures.
Figure 2:
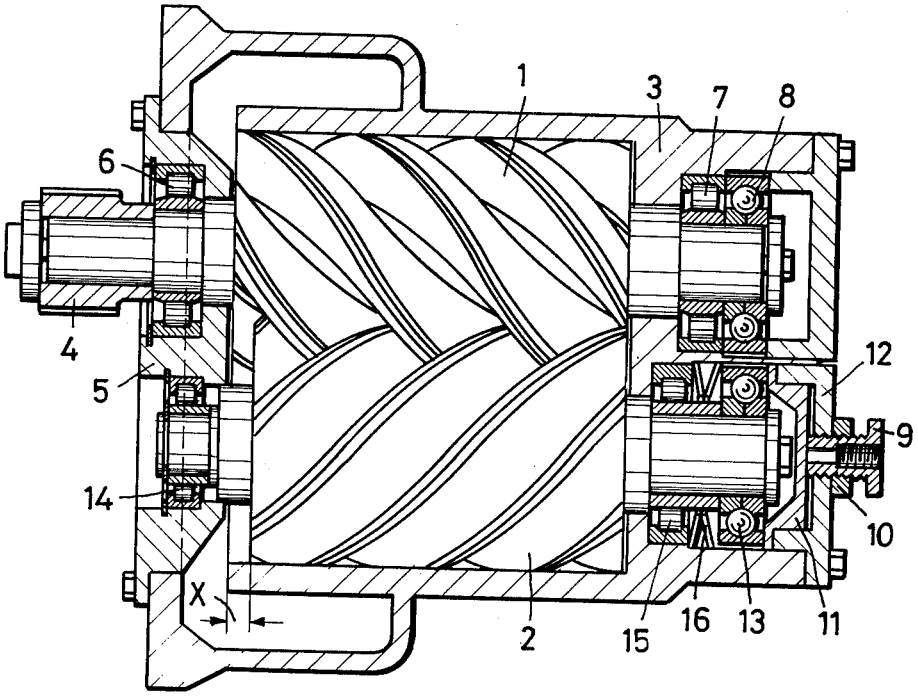
FIG. 2 is a longitudinal sectional view of a screw compressor embodying the invention, and showing the position of parts for producing full output delivery.
Figure 3:
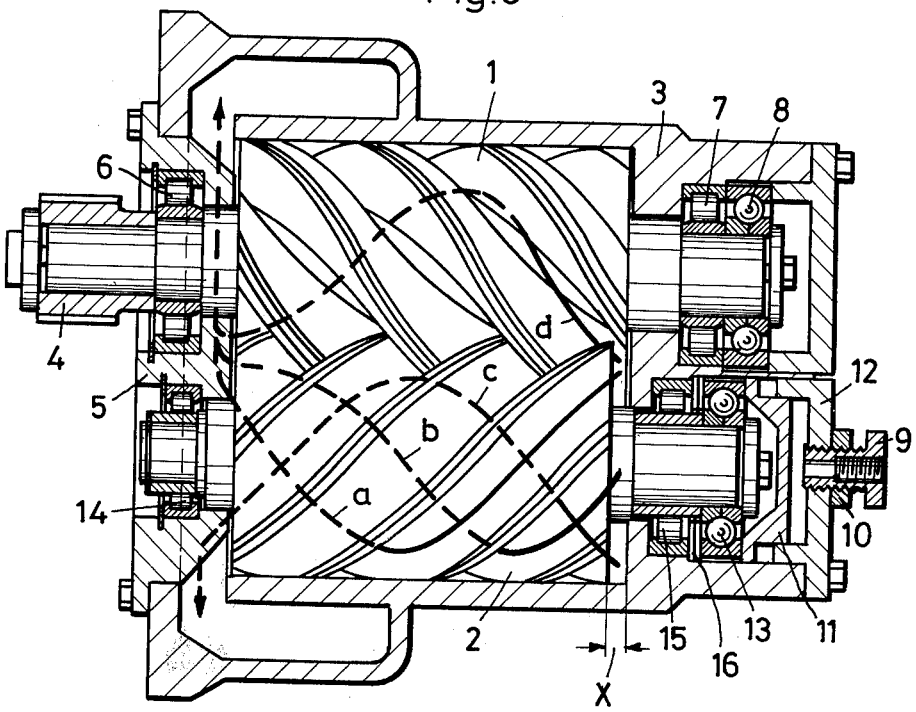
FIG. 3 is the same view as in FIG. 2, but with the parts in position for idling and zero delivery.

During zero delivery (FIG. 3), female rotor 2 is displaced towards the suction side by operating piston 11, so that a cylindrical space of the length "X" results between the end wall of the helical part of rotor 2 and pressure-side end of the working chamber. The pressure in cylinder 12 acts against the pressure of return spring 16. In this position, the coils of spring 16 are close together so that the spring forms a spacer element bounding displacement of rotor 2 towards the suction side. The axial bolt bearing of rotor 2 is such that only the minimum axial clearance necessitated by the construction exists between the end of the helical part of rotor 2 and the suction-side end wall of the working chamber. There is, however, a sealing effect between rotor 2 and suction side end wall. In contrast, the sealing effect of the female rotor at the pressure-side end wall of the working chamber is cancelled in this position of rotor 2, and compressed gas, as well as further aspirated gas quantities, may pass through the opened slots between rotors 1 and 2 to the suction side. The paths opening up in the slots of female rotor 2 are indicated by *a, b, c.* At least one path, marked *d,* opens up in a slot of male rotor 1.

I claim:

1. Rotary compressor apparatus of the axial flow screw rotor type, comprising (a) a male and a female rotor mounted with coplanar axes to rotate in intermeshing relation in said apparatus;

(b) a housing defining a working chamber for said rotors;

(c) said working chamber comprising two longitudinally extending intersecting bores with coplanar axes;

(d) said rotors rotating in sealing engagement with the walls of said bores without touching;

(e) axially spaced end wall portions in said housing transverse to said coplanar axes of said bores;

(f) said end wall portions being axially spaced from the ends of said rotors to provide mounting clearance for said rotors;

(g) a low pressure port in one said end wall portion and a high pressure port in the other said end wall portion and means for recycling output volume from said high pressure port to said low pressure port; the improvement characterized by (h) one of said rotors being axially shorter beyond mounting limitations than the said longitudinally extending axial bore therefor and axially shorter than the other rotor; and (i) said shorter rotor being axially displaceable toward and away from one said end wall portion for recycling output volume from said high pressure port to said low pressure port.

2. The apparatus of claim 1, further characterized by (a) said female rotor being said shorter rotor.

3. The apparatus of claim 1, further characterized by (a) a piston and cylinder arrangement disposed adjacent one said end wall portion; and (b) said piston and cylinder arrangement connected to said shorter rotor for the axial displacement thereof.

4. The apparatus of claim 3, further characterized by (a) said piston and cylinder arrangement disposed adjacent said high pressure end wall portion;

(b) resilient means mounted between said piston and cylinder arrangement and said shorter rotor for urging said shorter rotor toward said high pressure port.

5. The apparatus of claim 4, further characterized by (a) means for connecting said piston and cylinder arrangement to a source of pressure fluid on the side thereof opposite said resilient means; and (b) said pressure fluid urging said resilient means and said shorter piston toward said inlet port whereby flow paths are opened through said rotors between the high pressure end of said working chamber and the low pressure end thereof to unload said compressor.

* * * * *